United States Patent [19]

van Alst

[11] Patent Number: 4,552,429

[45] Date of Patent: Nov. 12, 1985

[54] MODULAR ELECTRICAL CONNECTOR FOR CONNECTING WIRES IN CABLE ENDS

[75] Inventor: Gerardus M. van Alst, Oss, Netherlands

[73] Assignee: AMP Incorporated, Harrisburg, Pa.

[21] Appl. No.: 656,795

[22] Filed: Oct. 1, 1984

[51] Int. Cl.[4] ..... H01R 13/39

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,202,957 | 8/1965 | Leach | 339/98 |
| 3,617,983 | 11/1971 | Patton | 339/98 |
| 3,865,460 | 2/1975 | Cherney et al. | 339/98 |
| 3,945,705 | 3/1976 | Seim et al. | 339/98 |
| 4,047,784 | 9/1977 | Trank | 339/98 |
| 4,127,312 | 11/1978 | Fleishhacker | 339/99 R |

*Primary Examiner*—Joseph H. McGlynn

*Attorney, Agent, or Firm*—F. W. Raring

[57] ABSTRACT

Electrical connector assembly comprises an intermediate body portion having oppositely facing first and second major surfaces and cover members. One-piece stamped and formed electrical terminals are mounted in the body. Each terminal has a first end portion which extends from the first major surface and a second end portion which extends from the second major surface. The end portions have wire-receiving slots. Each end portion has an associated plate-like wire cutter in spaced parallel relationship thereto. The wire cutters are integral with the end portions of the terminal and the first end portion and first wire cutter are spaced apart by a distance which is less than the distance between the second end portion and the second wire cutter to permit stacking to make tap-type connections.

11 Claims, 12 Drawing Figures

MODULAR ELECTRICAL CONNECTOR FOR CONNECTING WIRES IN CABLE ENDS

FIELD OF THE INVENTION

This invention relates to modular electrical connectors of the type used for splicing the wires in a first cable to the wires in a second cable. Connectors of this type are used commonly for splicing telephone cables and the connectors have wire cutters therein so that the ends of the wires can be trimmed when the connector is installed on the ends of the wires.

BACKGROUND OF THE INVENTION

U.S. Pat. No. 3,708,779 discloses a modular electrical connector assembly of a type which is commonly used for splicing the wires in the ends of telephone cables to each other. The connector assembly in its simplest form comprises an intermediate body section having oppositely directed major surfaces and having electrical terminals extending through the body section which project beyond the major surfaces. Wire cutters are provided in the terminal ends so that wires can be moved laterally of their axes, into the wire-receiving slots of the terminals, and past the cutting edges of the wire cutters. The ends of the wires are thus trimmed when the connector is installed on the wire ends. The above-identified U.S. Pat. No. 3,708,779 also describes a tool of the type used by cable splicers which tool has wire jigs or fixtures for locating the wires in alignment with the terminals in the connector and which also has a ram device for assembling cover members to the connector body. An advantageous feature of modular connectors of this type is also that tap-type connections can be made by using an additional body section.

Connectors of the type shown in U.S. Pat. No. 3,708,779 are widely used in the communications industry for cable splicing operations. Cables can be spliced in a relatively short time with connectors of this type and, after the cables are spliced, it is a relatively simple matter to carry out any subsequent repairs or testing which might be required. The individual connectors can be inspected and tested for any ineffective electrical connections if problems are encountered at a later date. Furthermore, the fact that tap-type connections can be made with the same connector components as are used for simple splicing operations is highly advantageous in that all of the operations required in the installation of communications cables, splicing and tap connections, can be carried out with one type of tool and connector components of standardized design.

Connectors of the type shown in U.S. Pat. No. 3,708,779 require that the electrical terminals used to connect the wires to each other be separate from the cutting blades which are employed to trim the wire ends at the time of installing the connector on the ends of the cables. Additionally, the moldings required for the connector body or the connector housing are relatively complex. Additionally, four different molded parts are required for a complete connector assembly. It would be desirable to achieve the advantages of the connector system shown in U.S. Pat. No. 3,708,779 with terminals and cutters of simplified construction and with fewer molded parts in the connector body than are required with these known connector types. The present invention is directed to a simplified connector assembly in which the wire cutter is integral with the electrical terminals and which requires a reduced number of types of molded parts.

THE INVENTION

The invention comprises an electrical connector of the type having an insulating body on which there are provided oppositely directed first and second major surfaces. A plurality of double-ended electrical terminals are mounted in, and extend through, the insulating body at predetermined terminal sites. Each of the terminals has a plate-like first end portion which extends from the first surface and a plate-like second end portion which extends from the second major surface. Each of the end portions has an outer edge which is spaced from its associated major surface and has side edges which extend from its outer edge to the associated major surface. Each of the first and second end portions has a wire-receiving slot which extends inwardly from its outer edge. The connector is characterized in that at least one of the plate-like end portions has a wire cutter in parallel, aligned relationship thereto, the wire cutter having a cutting edge and side edges which are in substantial alignment with the outer edge and the side edges respectively of the one plate-like end portion. A connecting section is provided which connects the one plate-like end portion to the wire cutter. The terminal and the wire cutter are of one-piece construction and are produced by bending a flat blank and locating the wire cutter in alignment with the one plate-like end portion so that first and second wires can be connected to each other by moving the wires laterally of their axes into the wire-receiving slots of each of the end portions, and the wire which is moved into the slot in the one end portion will be cut by the wire cutter.

In accordance with further embodiments, the terminal has a second wire cutter in parallel aligned relationship with the remaining end portion of the terminal. In one embodiment, the first and second wire cutters are spaced from the first and second end portions respectively, the first wire cutter being spaced from the first end portion by a distance which is less than the spacing between the second wire cutter and the second end portion whereby the insulating body of the connector assembly can be stacked onto a substantially identical insulating body with the first wire cutters and the first end portions of the terminals in one of the bodies between the second wire cutters and the second end portions of the terminals in the other insulating body.

In accordance with further embodiments, each of the terminals has intermediate portions which extend in opposite directions transversely of the planes of the end portions and of the planes of the cutters. The first and second end portions and the first and second cutters extend from the intermediate portions and the intermediate portions are within the insulating body and are substantially parallel to, and medially between, the first and second major surfaces. The insulating body may comprise first and second body parts, the body parts having opposed first and second internal faces which are substantially against each other when the parts are assembled. The intermediate portions of the terminals are between the opposed first and second internal faces.

In accordance with a further embodiment, each of the first and second body parts has at each of the terminal sites a proximate pair of slots and a remote pair of slots. Each of the slots extends from the internal face of its associated body part to the major surface of the associated body part. Each pair of proximate slots is spaced apart by a distance equal to the spacing between the first end portion and the first wire cutter of the terminals. Each pair of remote slots is spaced apart by a distance equal to the spacing between the second end portion and the second wire cutter of each of the terminals. Each of the body parts has a recess at each terminal site extending from the internal face towards the major surface of the body part and between the proximate pair of slots. Each recess is dimensioned to receive a connecting section of the terminal which is located at the terminal site.

THE DRAWING FIGURES

Figure 3:
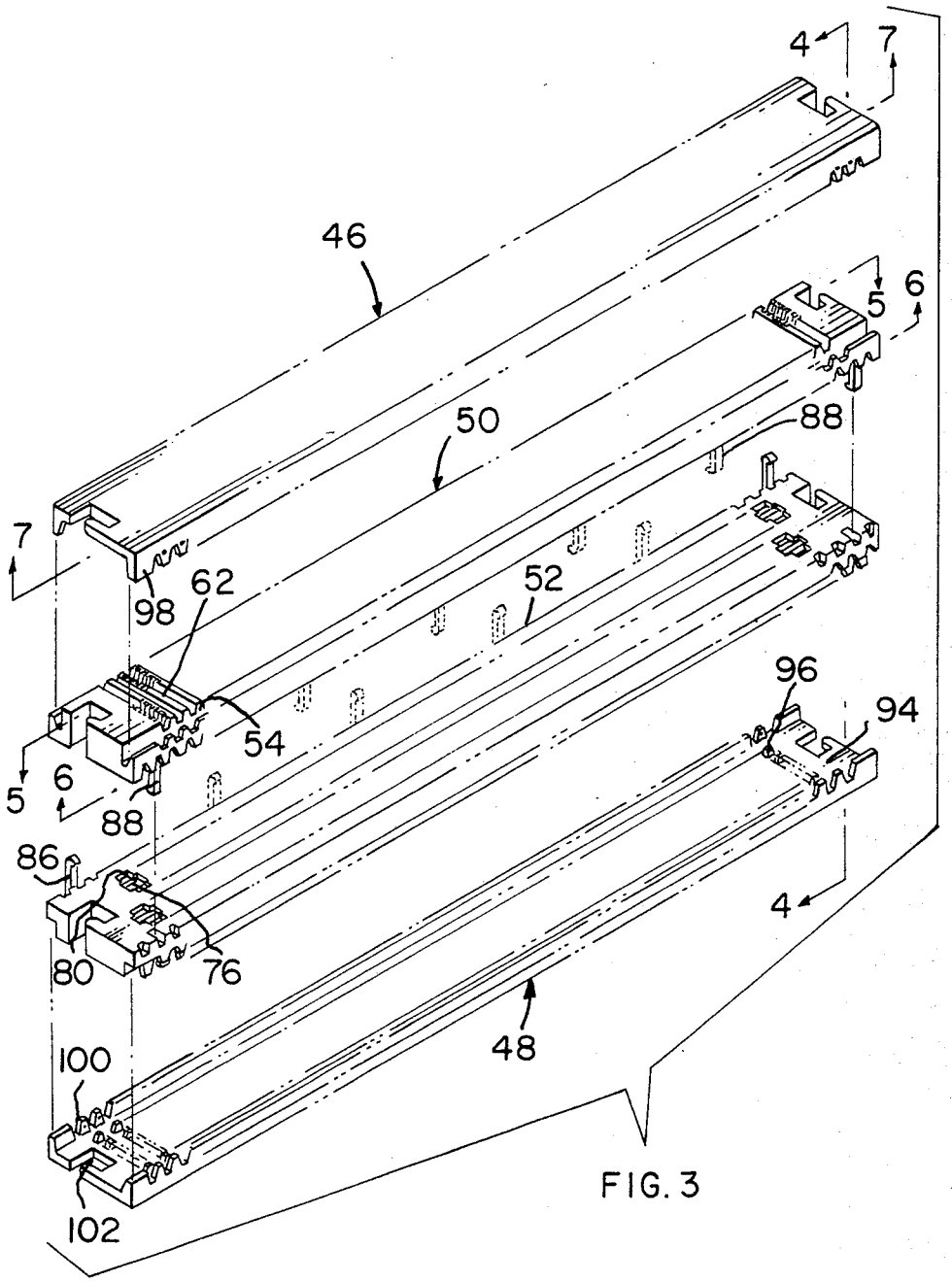
FIG. 3 is a view similar to FIG. 1 but with the parts of the connector assembly exploded from each other.
Figure 5:
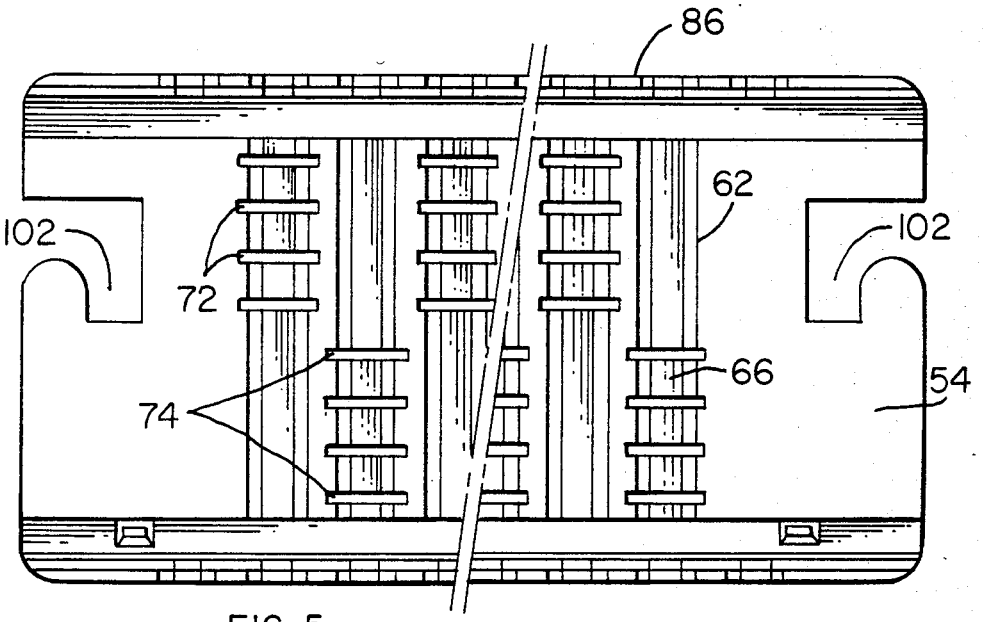
Figure 6:
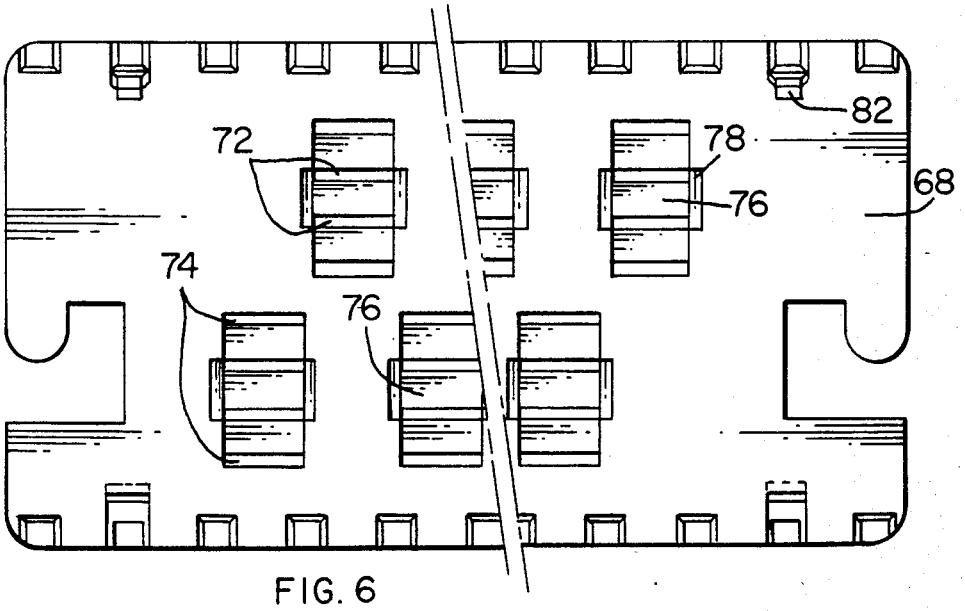

FIGS. 5 and 6 are views looking in the direction of the arrows 5—5 and 6—6 of FIG. 3.

Figure 7:
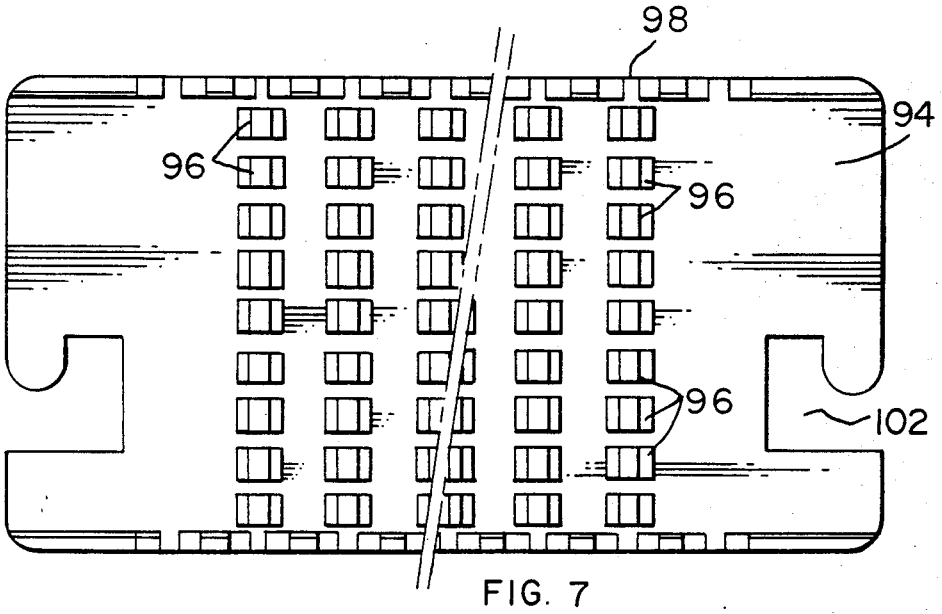

FIG. 7 is a plan view of the internal surface of one of the cover members looking in the direction of the arrows 7—7 of FIG. 3.

Figure 2:
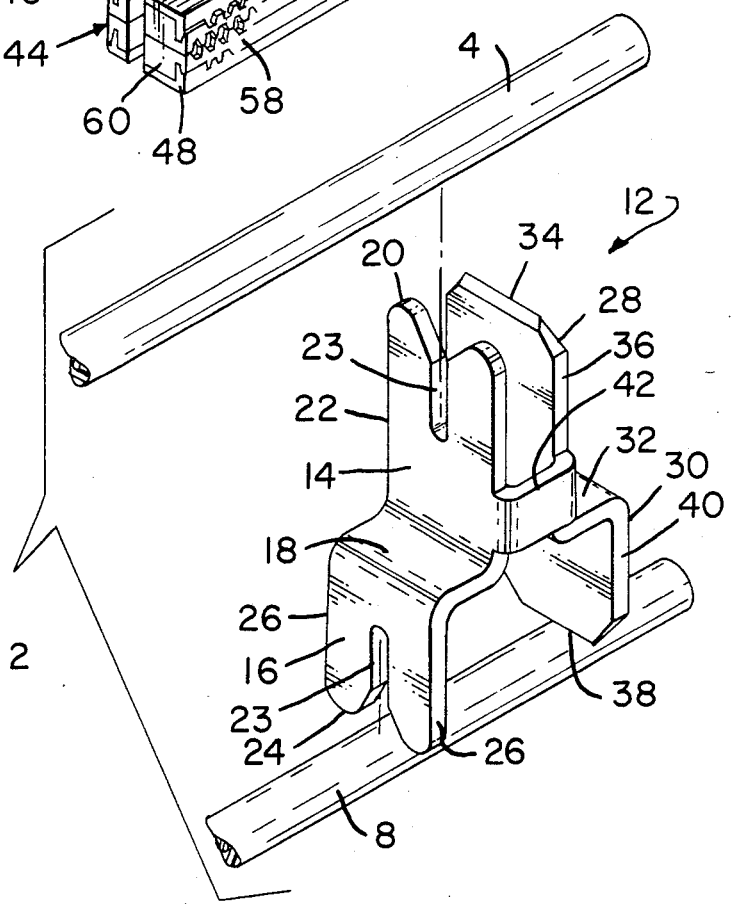
FIG. 2 is a perspective view of a terminal of the type used in the connector.
Figure 8:
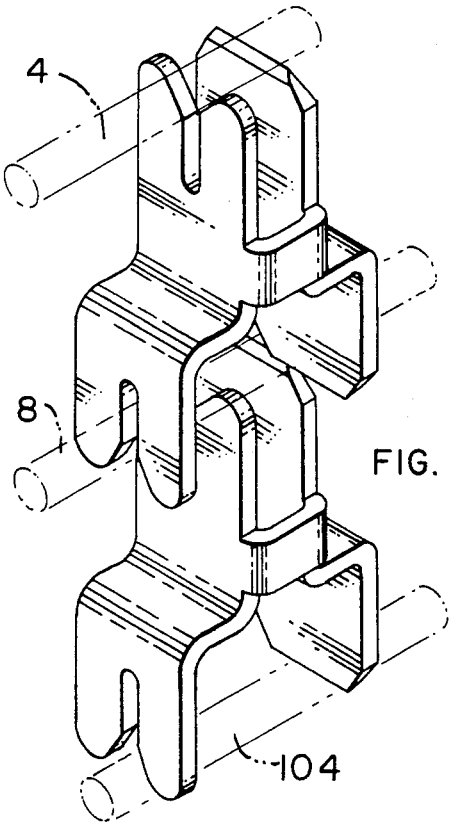

FIG. 8 is a view similar to FIG. 2 but showing two terminals in stacked or nested relationship.

Figure 4:
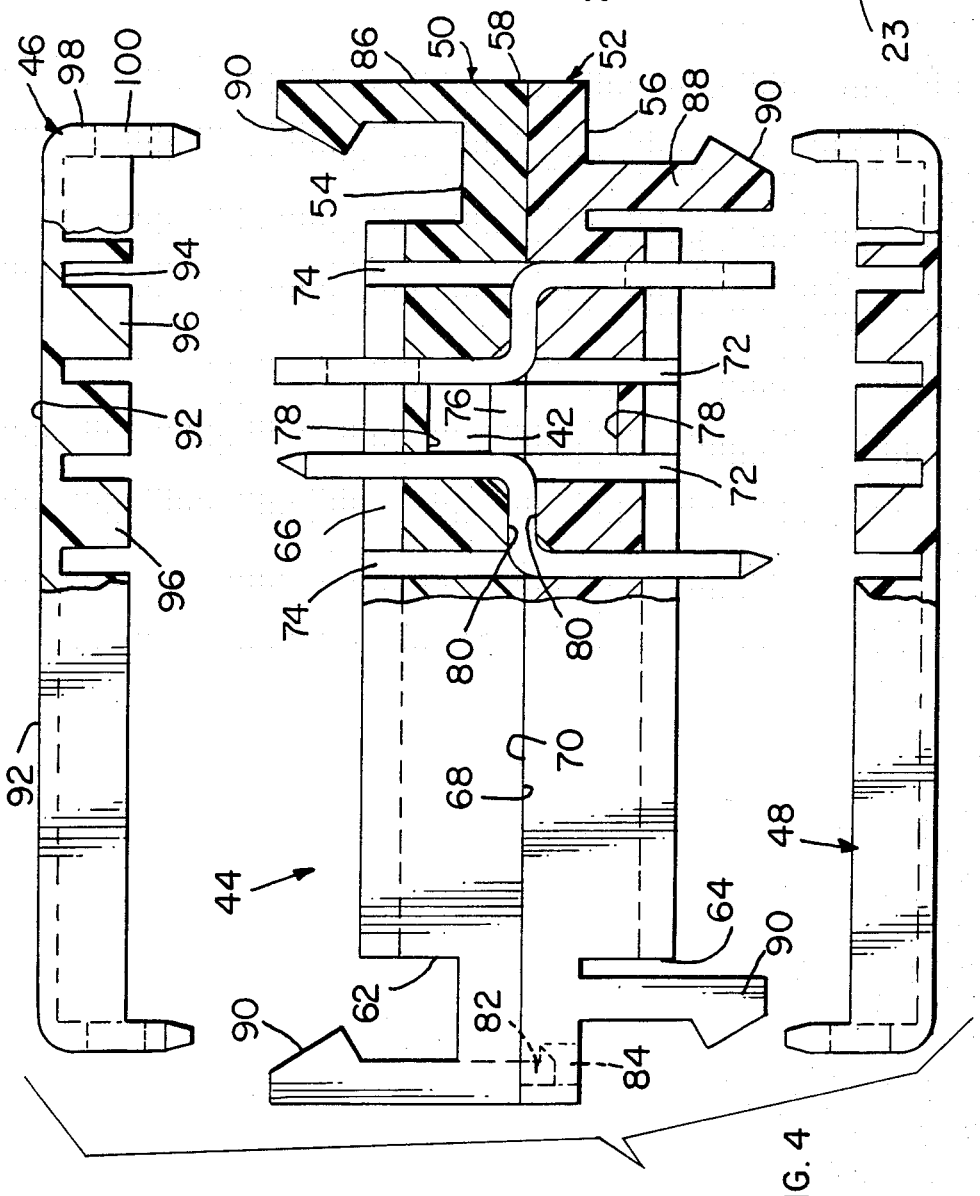
FIG. 4 is a view, partly in section, looking in the direction of the arrows 4—4 of FIG. 3 but with the two sections of the intermediate body assembled to each other.
Figure 9:
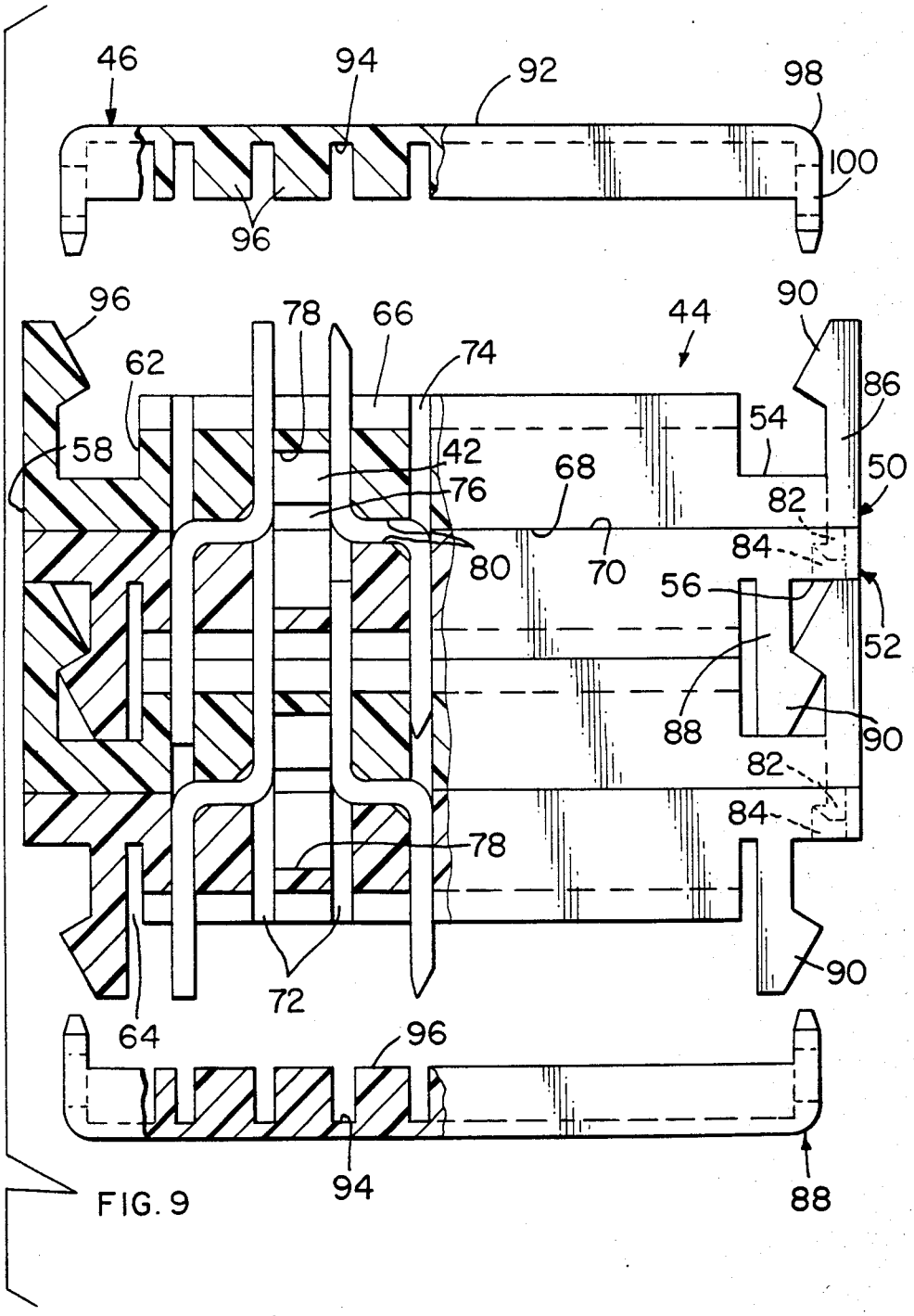

FIG. 9 is a view similar to FIG. 4 but illustrating the manner of stacking two body assemblies to form tap connections.

Figure 10:
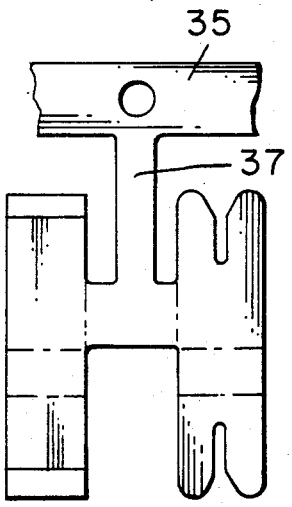

FIG. 10 is a plan view of a short section of strip having a blank integral therewith which is later formed to produce the terminal of FIG. 2.

Figure 11:
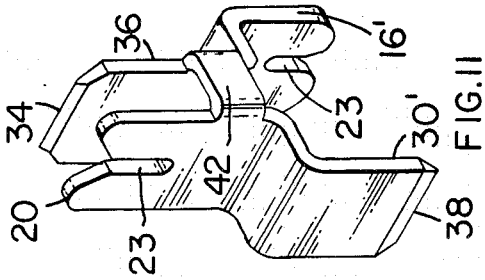
Figure 12:
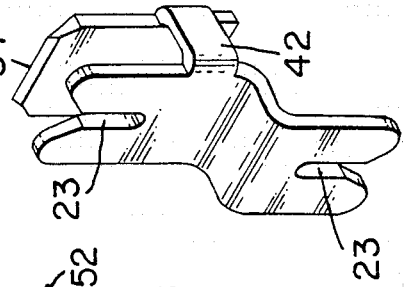

FIGS. 11 and 12 are perspective views of alternative forms of terminals.

THE DISCLOSED EMBODIMENT

Figure 1:
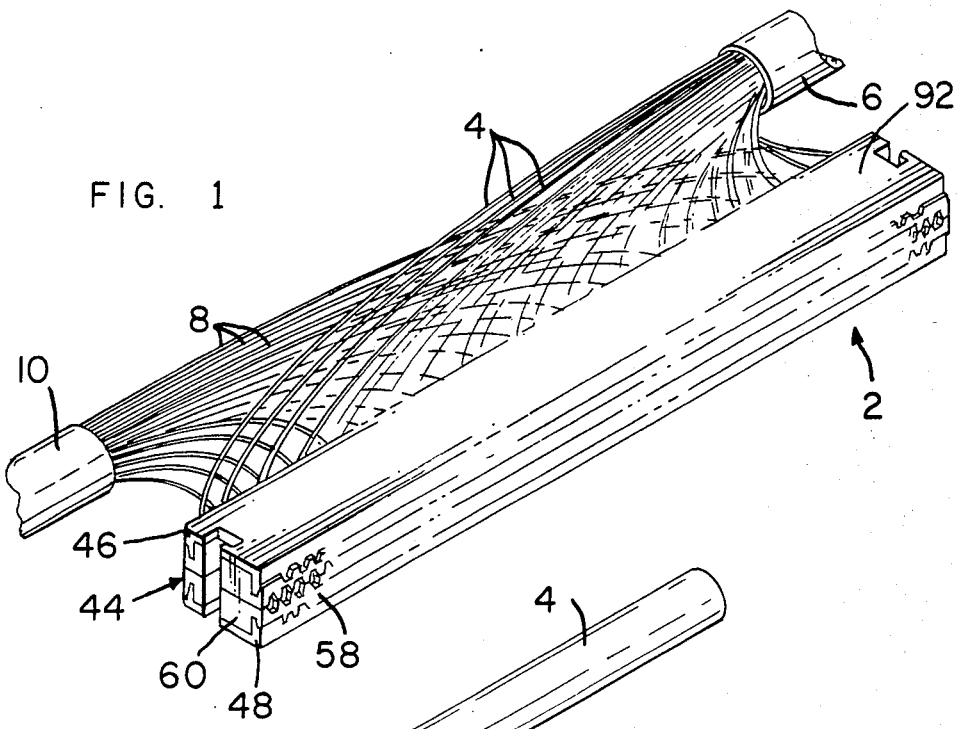
FIG. 1 is a perspective view of an electrical connector assembly in accordance with the invention and cables having wires extending to the connector assembly.

FIG. 1 shows a connector assembly 2 in accordance with the invention installed on a plurality of first wires 4 in a first cable 6 and on a plurality of second wires 8 in a second cable 10. A plurality of individual terminals 12 are contained in the connector assembly and each terminal, FIG. 2, serves to connect one first wire 4 to a second wire 8 as shown.

The terminal 12 is of stamped and formed conductive sheet metal and is produced from a blank in strip form as shown in FIG. 10. The terminal has first and second end portions 14, 16 which are connected to each other by an intermediate portion 18 that extends horizontally with reference to the planes of the end portions. The first end portion 14 has an outer or free intermediate portion. A wire-receiving slot 23 extends downwardly from the outer edge 20. The second end portion 16 has an outer edge 24 in which there is provided a wire-receiving slot and parallel side edges 26.

First and second wire cutters 28, 30 are provided for each of the end portions, the wire cutters being connected to each other by an intermediate section 32 that is coplanar with the intermediate section 18. The first wire cutter has a cutting edge 34 in alignment with the outer edge 20 of the first end portion and has side edges 36. The second wire cutter has a cutting edge 38 in alignment with outer end 24 and side edges 40. The two wire cutters are plate-like members and are in planes parallel to the planes of the end portions. The first end portion is spaced from the wire cutter 28 by a distance which is substantially less than the spacing between the second end portion 16 and the second wire cutter 30 so that the terminals can be nested or stacked as shown in FIG. 8 and as will be described below. The first and second end portions 14, 16 are connected to the first and second wire cutters by a connecting section 42 that is integral with aligned side edges 22, 36 of the first end portion and the first wire cutter. The final shape is achieved by bending the blank of FIG. 10 along bend lines as indicated in FIG. 10. As illustrated in FIG. 2, a wire 4 can be connected to a wire 8 by moving the wires laterally of their axes and into the wire-receiving slots 23. During such movement, the end portions of the wires will be trimmed by the cutting edges 34, 38.

The individual blanks of FIG. 10 are connected to a continuous carrier strip 35 by connecting sections 37. When the terminals are fully formed, they can be reeled and then assembled to the connector body by automatic or semiautomatic machinery.

The insulating housing of the connector assembly comprises four molded parts, two of which 46, 48 are identical to each other and two of which are similar although not identical. As shown in FIGS. 3 and 4, the housing assembly comprises an intermediate connector body assembly 44 and top and bottom covers 46, 48. The intermediate connector body 44 is comprised of first and second body sections 50, 52. When these sections are assembled to each other, the intermediate body 44 has a first major surface 54 which faces upwardly in the drawing and a second major surface 56 which faces downwardly. The completed assembly as shown in FIG. 1 has oppositely facing sidewalls 58 and oppositely facing endwalls 60.

The first and second major surfaces of the first and second body portions 50, 52 have parallel ribs 62, 64 thereon which extend between the sidewalls but which do not extend to the sidewalls 58 as best shown in FIG. 5. The terminal sites are indicated by slots 72, 74 which are described fully below and which extend through the body sections. The locations of the terminal sites on the first major surface 54 are in alignment with the locations on the second major surface and, insofar as the ribs 62 and the terminal sites are concerned, the first and second major surfaces are mirror images of each other.

The parallel ribs 62, 64 on the first and second major surfaces 54, 56 have central recesses 66 which receive the wires and the slots, which receive the end portions of the terminals, intersect these recesses and the ribs.

The two body sections have first and second internal faces 68, 70 which are against each other when the parts are assembled as shown in FIG. 4. At each terminal site, a proximate pair of slots 72 extend from the internal face 68 or 70 through each body portion and intersect the adjacent rib 62. The spacing between the internal pair of slots or proximate pair of slots is equal to the spacing between the first end 14 and the first wire cutter 28 of a terminal 12. A second or remote pair of slots 74 are provided at each terminal site and the spacing between these slots is the same as the spacing between the second end 16 and the second wire cutter 30 of a terminal. At each terminal site, each of the first and second body sections 50, 52 is provided with a recess 76 which extends from the internal face towards the major surface and which is located between the proximate pair of slots 72 at the site. These recesses are of sufficient width to receive the connecting sections 42 of the terminals and shoulders 78 are provided for the upper edges of the connecting sections at the end of each recess. Finally, shallow recesses 80 are provided on the internal faces of the body sections for the intermediate portions 18, 32 of the terminal.

It will be apparent from the foregoing that the individual terminals can be assembled to either of the body sections by simply aligning either the second end portion and the second wire cutter with a pair of the remote slots 74 or aligning the first end portion 14 and the first wire cutter with a pair of proximate slots 72. After aligning the parts, the end portion and the wire cutter are inserted through the slots. Thereafter, the other body section is assembled to the section in which the terminals have been mounted. It should be noted that the terminals can be inserted in either of two orientations. Thus, in FIG. 4, the cutting edges of the terminal shown on the left and the end portions of the terminal are on the right. Obviously, the two body sections could be disassembled from each other, the terminal could be removed, rotated 180 degrees about its vertical axis, and then reinserted. If this were done, the cutting edges would be on the right and the end portions of the terminal would be on the left in FIG. 4.

The first and second body in sections 50, 52 are secured to each other in any suitable manner. This can be done with an adhesive or by welding if desired. In the disclosed embodiment, relatively simple short latch arms 82 are provided on the body section 50 and complementary openings are provided on the left in the lower body section as shown at 84. Similar latch arms can be provided on the right in FIG. 4 as required to secure the parts to each other.

In order to secure the connector body assembly 44 to the cover members 46, 48 and to secure an assembly 44 to an additional connector body assembly as will be described below, latch arms 86, 88 are provided on the first and second major surfaces 54, 56. The latch arms 86 on the first major surface are immediately adjacent to the sidewalls 58 and the latch arms 88 on surface 56 are inwardly spaced from the sidewalls as shown. The latch arms have englarged and contoured ends 90 which are shaped such that the latch arms 88 of a connector body 44 can be engaged with the latch arms 86 of an adjacent connector body as shown in FIG. 9 and as will be described below.

The cover members 46, 48 are identical to each other as noted above. Each cover has an outer surface 92 and an internal surface 94 which is opposed to the associated major surface 54 or 56 of the body 44. Bosses 96 are provided on the internal surface in opposed relationship to the ribs 62 and the bosses are spaced apart by distances such that the outer end portions of the terminals and the wire cutters will be received in the slots formed between bosses as is evident from FIG. 4.

The cover members have flanges 98 extending from their side edges and openings 100 are provided in these flanges for reception of the enlarged ends 90 of the latch arms 86 or 88. As shown in FIG. 4, when a cover member is assembled to the upper body section or first body section, the latch arms 86 will be located outwardly of the flanges 98 and the enlarged ends will enter the openings 100 from the right. When a cover member is assembled to the lower surface 56, the latch arms 88 will be located inwardly of the flanges and the enlarged ends of the latch arms will enter the openings from the left.

FIG. 8 illustrates the manner in which a tap connection can be made with connector components in accordance with the invention. The first and second wires 4, 8 are connected to each other by the upper terminal shown in FIG. 8 and as previously described. When a terminal is located beneath the upper terminal, the upper or first end portion of the lower terminal will also be connected to the wire 8. The third wire or tap wire 104 is connected to the second end portion of the lower terminal and is trimmed by the wire cutter of the lower terminal.

FIG. 9 illustrates the manner in which a tap connection can be made to cable ends by using two connector bodies 44. This view also illustrates the manner in which the latch arms 86, 88 serve to secure two connector bodies 44 to each other.

The cover members 46, 48 and the body section 50, 52 are provided with L-shaped recesses 102 in their endwalls. These recesses are provided so that the connector assembly can be used in existing types of tools as shown in the above-identified U.S. Pat. No. 3,708,779.

FIGS. 11 and 12 show alternative types of terminals which can be used in the practice of the invention. In FIG. 11, the position of the second end portion 16' and the second wire cutter 30' are interchanged. An advantage in the use of terminals of this type is that the wires can be dressed from opposite sides of the connector assembly when a splice is made. In FIG. 1, all of the wires 4, 8 are dressed from the rearward side of the assembly 2 towards the connector body.

FIG. 12 shows a terminal in which one of the wire cutters is eliminated. This type of terminal can be used to make a tap connection intermediate the ends of a cable. The wires of the cable are simply inserted into the slot of the one end portion which does not have a wire cutter associated therewith. The tap wires are then connected to the remaining end of the terminal.

It will be apparent from the foregoing that the wires in two cables can be connected to each other by the use of a tool as shown in U.S. Pat. No. 3,708,779 and a connector in accordance with the invention. The procedure followed is to simply position a cover member in the tool, locate wires from one of the cable ends in the wire-holding fixture of the tool and then assemble the intermediate body portion of the connector to the lower cover member 48. Thereafter, the wires in the other cable are positioned in the wire-holder of the tool and inserted into the wire-receiving slots of the terminals. Finally, the cover is assembled to the body portion of the connector assembly.

The plastic molded parts required for a connector in accordance with the invention are of simplified design and are, therefore, produced at a lower cost than previously known moldings. Furthermore, the fact that the cutters are integral with the terminals and the fact that the cover members are identical to each other substantially reduces the number of different part types required to make connections. As noted above, only three different types of molded parts are required since the covers 46, 48 are identical.

I claim:

1. An electrical connector of the type comprising an insulating body having oppositely directed first and second major surfaces and a plurality of double-ended electrical terminals mounted in, and extending through, the insulating body at terminal sites, each of the terminals having a plate-like first end portion which extends from the first surface and a plate-like second end portion which extends from the second major surface, each of the end portions having an outer edge which is spaced from its associated major surface and having side edges which extend from its outer edge to the associated major surface, each of the first and second end portions having a wire-receiving slot which extends inwardly from its outer edge, the connector being characterized in that:

the first and second plate-like end portions have first and second wire cutters in alignment therewith respectively, the first and second wire cutters each having a cutting edge and having side edges which are in substantial alignment with the outer edges and the side edges respectively of the first and second plate-like end portions respectively, the first and second wire cutters being spaced from the first and second end portions respectively, the first wire cutter being spaced from the first end portion by a distance which is less than the spacing between the second wire cutter and the second end portion, a connecting section is provided which connects the first and second plate-like end portions to the first and second wire cutters, each of the terminals being of one piece construction and having been produced by bending a flat blank and locating the wire cutters in alignment with the plate-like end portions whereby, first and second wires can be connected to each of the terminals by moving the wires laterally of their axes and into the wire-receiving slots of each of the end portions, and the wires will be cut by the wire cutters during movement into the wire-receiving slots, and the insulating body can be stacked onto a substantially identical insulating body with the first wire cutters and the first end portions of the terminals of one of the bodies between the second wire cutters and the second end portions of the terminals in the other insulating body.

2. An electrical connector as set forth in claim 1 characterized in that the connecting section of each terminal extends between corresponding aligned side edges of the first cutter and the first end portion.

3. An electrical connector as set forth in claim 2 characterized in that each of the terminals has intermediate portions which extend in opposite directions transversely of the planes of the end portions and the cutters, the first and second end portions and the first and second cutters extending from the intermediate portions, the intermediate portions being within the insulating body and being substantially parallel to, and medially between, the first and second major surfaces.

4. An electrical connector as set forth in claim 3 characterized in that the insulating body comprises first and second body parts, the body parts having opposed first and second internal faces which are substantially against each other, the intermediate portions of the terminals being between the opposed first and second internal faces.

5. An electrical connector as set forth in claim 4 characterized in that each of first and second body parts has at each of the terminal sites a proximate pair of slots and a remote pair of slots, each of the slots extending from the internal face of its associated body part to the major surface of its body part, each pair of proximate slots being spaced apart by a distance equal to the spacing between the first end portion and the first wire cutter of the terminals, each pair of remote slots being spaced apart by a distance equal to the spacing between the second end portion and the second wire cutter of the terminals.

6. An electrical connector as set forth in claim 5 characterized in that each of the body parts has a recess at each terminal site extending from the internal face toward the major surface of the body part and between the proximate pair of slots, the recess being dimensioned to receive the connecting section of the terminal at the terminal site.

7. an electrical connector as set forth in claim 4 characterized in that the insulating body has oppositely directed side surfaces which extend between the first and second major surfaces, first latch arm means on the side surfaces proximate to the first major surface and second latch arm means on the side surfaces proximate to the second major surface, the first and second latch arm means being cooperable respectively with second and first latch arm means of a substantially identical connector to latch the connector to the substantially identical connector when the connectors are stacked.

8. An electrical connector as set forth in claim 7 characterized in that first and second covers are provided for the first and second major surfaces, the first and second covers having shoulders which are cooperable with the first and second latch arm means to latch the covers to the insulating body.

9. An electrical connector as set forth in either of claims 1 or 5 characterized in that first and second covers are provided for the first and second major surfaces of the insulating body, the covers having cover recesses therein for reception of the end poritions and the cutters of the terminals.

10. An electrical connector as set forth in claim 9 characterized in that the terminal sites on the first and second major surfaces are mirror images of each other.

11. An electrical connector as set forth in claim 10 characterized in that the covers are identical to each other.

* * * * *